United States Patent [19]

Aoki

[11] Patent Number: 4,928,320

[45] Date of Patent: May 29, 1990

[54] BASEBALL CATCHING APPARATUS

[75] Inventor: Akio Aoki, Osaka, Japan

[73] Assignee: Trion Corporation, Osaka, Japan

[21] Appl. No.: 275,626

[22] Filed: Nov. 15, 1988

Related U.S. Application Data

[63] Continuation of Ser. No. 37,297, Apr. 8, 1987, abandoned.

[30] Foreign Application Priority Data

Jan. 17, 1987 [JP] Japan ..... 62-5218[U]

[51] Int. Cl.[5] ..... A41D 13/10; A63B 71/14

[52] U.S. Cl. ..... 2/19; 2/20

[58] Field of Search ..... 2/19, 20

[56] References Cited

U.S. PATENT DOCUMENTS

| | | | |
|---|---|---|---|
| Re. 12,996 | 7/1909 | Peach | 2/19 |
| 899,522 | 9/1908 | Gamble | 2/19 |
| 970,754 | 9/1910 | Rogers | 2/19 |
| 1,072,012 | 9/1913 | King | 2/19 |
| 1,072,697 | 9/1913 | Cameron | 2/19 |
| 1,198,716 | 9/1916 | Gamble | 2/19 |
| 1,362,280 | 12/1920 | Young | 2/19 |
| 2,672,611 | 3/1954 | Tompkins | 2/19 |
| 3,300,787 | 1/1967 | Denkert | 2/19 |
| 3,898,696 | 8/1975 | Campanis | 2/19 |
| 4,227,263 | 10/1980 | Zidele | 2/19 |
| 4,483,022 | 11/1984 | Aoki | 2/19 |
| 4,513,450 | 4/1985 | Aoki | 2/19 |
| 4,527,287 | 7/1985 | Aoki | 2/19 |
| 4,630,318 | 12/1986 | Aoki | 2/19 |
| 4,665,561 | 5/1987 | Aoki | 2/19 |

FOREIGN PATENT DOCUMENTS

| | | | |
|---|---|---|---|
| 0015178 | of 1909 | United Kingdom | 2/19 |

*Primary Examiner*—Henry S. Jaudon
*Assistant Examiner*—Sara M. Current
*Attorney, Agent, or Firm*—Jones, Tullar & Cooper

[57] ABSTRACT

A baseball catching apparatus having an outer face member constituting a ball-catching face of a palm side of the apparatus, an inner face mamber to come into contact with a palm, holding means disposed at a predetermined position in between the outer face member and the inner face member, and shock-absorbing means to be accommodated in the holding means and adapted for relieving ball catching shock.

6 Claims, 6 Drawing Sheets

BASEBALL CATCHING APPARATUS

This is a continuation of co-pending application Ser. No. 037,297 filed on Apr. 8, 1987, now abandoned.

BACKGROUND OF THE INVENTION

1. Field of the Invention

The present invention relates to a ball catching apparatus used for baseball or softball and the like.

2. Description of the Prior Art

Conventional baseball catching apparatuses such as shown in FIGS. 10 and 11, generally comprise therein shock-absorbing means 2 formed of such material as felt for relieving shock caused by catching a ball. The shock-absorbing means 2 is disposed, as shown in FIGS. 10 and 11, at a predetermined position in between an outer face member 11 (the member constituting a ball catching face) on a palm side of the apparatus body 1 and an inner face member 12 of the apparatus body 1. More specifically, the shock-absorbing means 2, which is constituted in practice by a single element or a plurality of separate elements, extends from the top of a thumb area through a lower end of a palm area and to a top of a little finger area as shown by broken lines in FIGS. 10 and 11. In order to prevent the shock-absorbing means 2 from being displaced in the course of use, several proposals have been made.

The shock-absorbing means 2 bound between the outer face member 11 and the inner face member 12 is securely fixed by a string 3 inserted and fastened through a plurality of openings 11*a* defined adjacent a peripheral edge portion of the body 1. However, since a considerable number of these openings are also positioned adjacent a central portion of the apparatus which is subjected the most to the ball catching shock, there occurs, after an extended use of the apparatus, an enlargment of the opening or breakage thereof.

Further, since the string 3 inserted through the openings 11*a* is formed of a harder material than the material of the shock-absorbing means 2, the string 3 is felt more strongly than the other portions by a user's palm at the time of catching a ball, thereby giving an uncomfortable feel to the user. In addition, this arrangement also deteriorates the ball catching performances since the ball catching area (the area not covered by the shock-absorbing means 2 and designed for catching) is considerably limited and the ball, when caught, tends to come into contact with the exposed projecting string 3.

SUMMARY OF THE INVENTION

It is the object of the present invention to provide a baseball catching apparatus which overcomes the above-described disadvantages of the prior art.

In order to achieve the above object, the baseball catching apparatus according to the present invention comprises an outer face member constituting a ball catching face forming a palm side, an inner; face member which comes into contact with a palm of a user, holding means disposed at a predetermined position in between the outer face member and the inner face member, and shock-absorbing means adapted for relieving ball catching shock, the shock-absorbing means being accommodated in the holding member.

Since the shock absorbing means is accommodated in the holding means disposed at a predetermined position, according to the baseball catching apparatus of the present invention having the above construction, neither the string provided in the prior art for fixedly positioning the shock-absorbing means nor the openings for inserting the string therethrough are necessary.

Also, the holding means formed of a flat piece, a bag or a case may be fixedly positioned by sewing in between the outer face member and the inner face member. The holding means is sewn by means of a thread either to the outer face member or to the inner face member. The holding means may also be conveniently fixed by means of a string for sewing lower edge portions of the apparatus body. Alternatively a convenient adhesive may be used for securedly positioning the shock-absorbing means, whereby production efficiency may be greatly improved.

As described above, since the baseball catching apparatus of the present invention has the construction which does not require the openings or the string for fixing the shock-absorbing means, the life of the apparatus may be extended due to improved durability of the outer palm face member and at the same time the ball-catching feel and the ball-catching performance are improved as well.

Other advantages and features of the baseball catching apparatus related to the present invention will become apparent from the following description of the preferred embodiments with reference to the accompanying drawings.

DESCRIPTION OF THE PREFERRED EMBODIMENTS

A baseball catching apparatus related to the present invention will be particularly described hereinafter with reference to the accompanying drawings.

Figure 1:
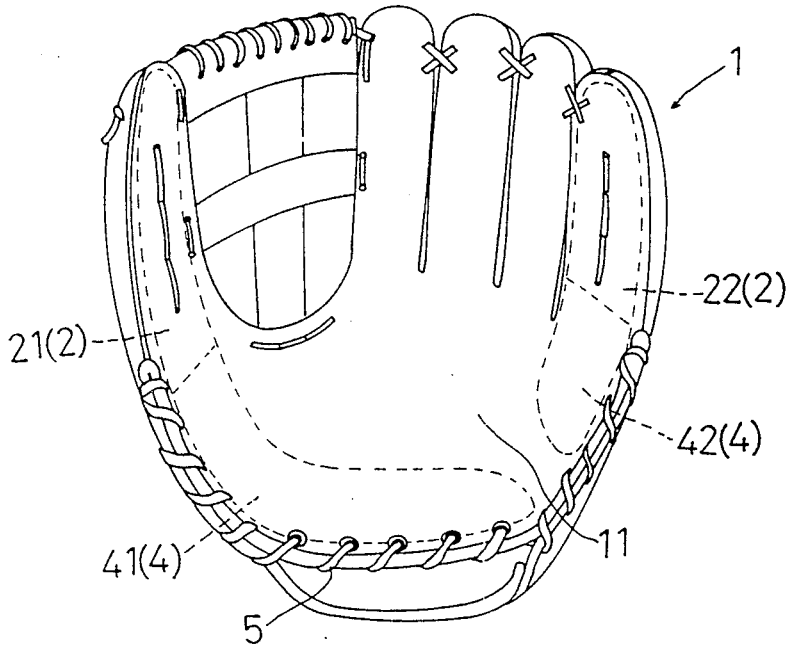
FIG. 1 is a front view of one embodiment of a baseball catching apparatus according to the present invention as seen from a ball-catching face side thereof.
Figure 2:
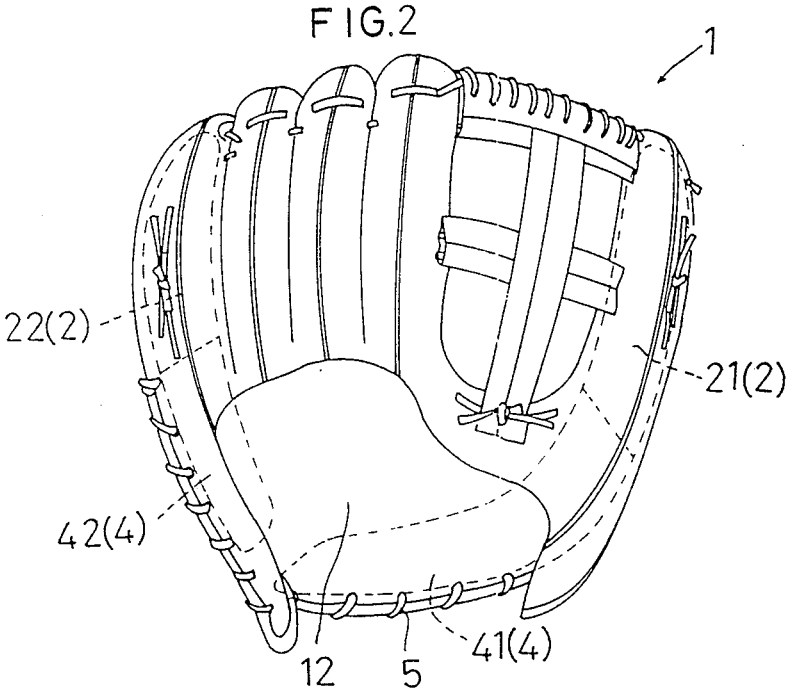
FIG. 2 is a partially cut-out back view of the apparatus shown in FIG. 1.

Referring to FIG. 1 and FIG. 2, the baseball catching apparatus according to the present invention comprises an outer face member 11 constituting a ball catching face forming a palm side of an apparatus body 1, an inner face member 12 which comes into contact with the palm of a user, and shock-absorbing means 2 disposed at a predetermined position in between the outer face member and the inner face member (specifically, an area extending from the top to the bottom of a thumb portion of the apparatus through a lower edge of the palm side up to the top of a little finger portion of the apparatus), the shock-absorbing means 2 being formed of felt or the like and adapted for relieving ball catching shock. In order to prevent the shock-absorbing means 2 from being displaced in the course of use, the following various embodiments of the present invention are proposed.

Figure 3:
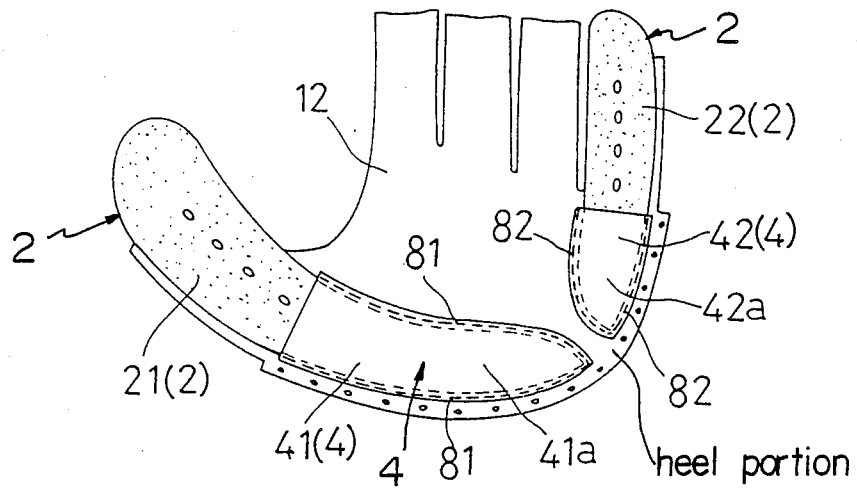
FIG. 3 is a view illustrating a relationship between an outer face member, a shock-absorbing member and its holding member.

At a predetermined position between the outer face member 11 and the inner face 12, there is provided holding means 4 for accompanying the shock-absorbing means 2. The holding means 4, as shown in FIG. 3, includes a bag 41 for accompanying a shock-absorbing element 21 to be disposed at a position extending from the top to the bottom of the thumb portion of the apparatus, and a bag 42 for accommodating another shock-absorbing element 22 to be disposed at a position extending from the top to the bottom of the little finger portion of the apparatus. These bags 41, 42 are respectively constituted in such a way that thin piece elements 41*a*, 42*a* respectively are fixedly sewn at their peripheral edges by means of threads 81, 82 to the inner face member 12 while leaving one of the edges thereof unsewn and thereby open.

With this construction for fixedly positioning the shock-absorbing means 2, neither the string disposed adjacent the central portion of the palm side for fixedly positioning the shock-absorbing means nor the openings for inserting the string therethrough are necessary.

Further, various modifications of the shock-absorbing means 2 are possible for improving its shock-absorbing performance. For example, the means 2 may have a thick peripheral portion facing the palm and a thin central portion. Or, the means 2 may have the peripheral portion facing the palm formed double-layered.

(First Alternate Embodiment)

Figure 4:
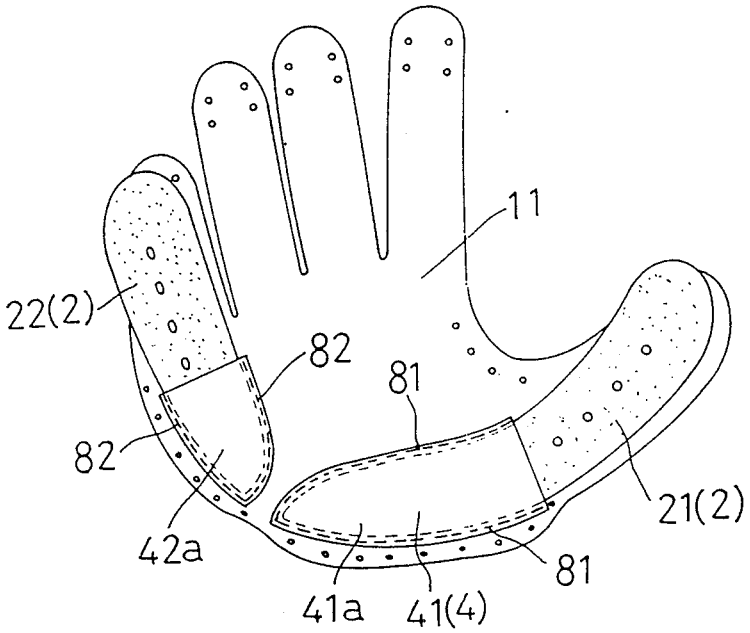
FIG. 4 is a view illustrating a first alternate embodiment of the outer face member, the shock absorbing member and its holding member of the baseball catching apparatus related to the present invention.

As shown in FIG. 4, the piece elements 41*a*, 42*a* may be sewn by means of the thread 81, 82 also to the outer face member 11. That is to say, these elements may be sewn in any other way if it is to increase productivity.

(Second Alternate Embodiment)

Figure 5:
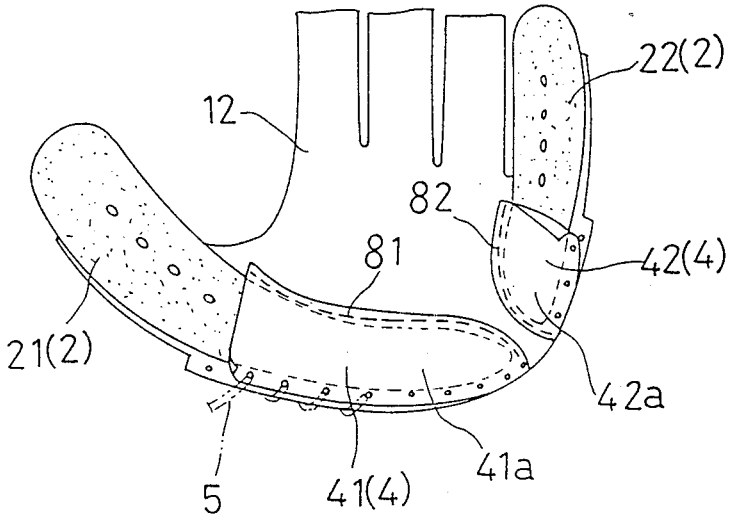
FIG. 5 is a view illustrating a second alternate embodiment of the outer face member, the shock absorbing member and its holding member of the baseball catching apparatus related to the present invention.

As shown in FIG. 5, the bags 41 and 42 may be constituted in another way. In this case as well as in the previous embodiment, one of the peripheral edges of the piece elements 41*a*, 42*a* are left un-sewn to remain open. However, the peripheral edges toward the central portion of the palm are fixedly sewn by means of the threads 81, 82 to the inner face member 12; whereas, the peripheral edges toward the lower end of the palm are fixed by means of the string 5 for sewing together with the lower end portions of the apparatus body 1.

Otherwise, it is also possible to fix the piece members 41*a* and 42*a* not to the inner face member 12 but to the outer face member 11.

(Third Alternate Embodiment)

Figure 6:
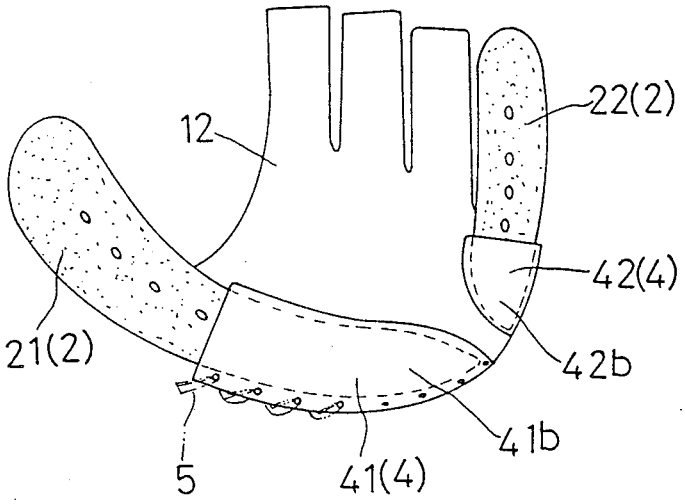
FIG. 6 is a view illustrating a third alternate embodiment of the outer face member, the shock absorbing member and its holding member of the baseball catching apparatus related to the present invention.

Referring now to FIG. 6, in this case as well as in the previous embodiments, certain ones of the peripheral edges of the piece elements 41*a*, 42*a* are left un-sewn to remain open and also the peripheral edges toward the lower end of the palm are fixed by means of the string 5 for sewing together with the lower end portions of the apparatus body 1. However, the peripheral edges toward the central portion of the palms are not fixedly sewn by means of the threads 81, 82 but by any other means such as by a convenient adhesive.

(Fourth Alternate Embodiment)

Figure 9:
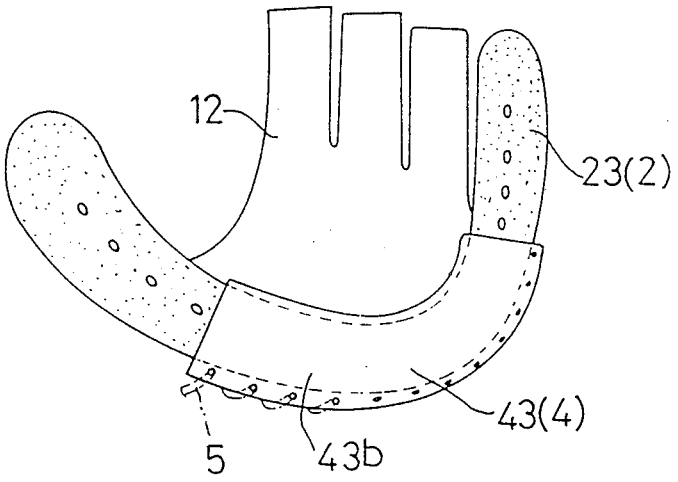
FIG. 9 is a view illustrating yet another alternate embodiment derived from the fourth alternate embodiment of the outer face member, the shock absorbing member and its holding member of the baseball catching apparatus related to the present invention.
Figure 10:
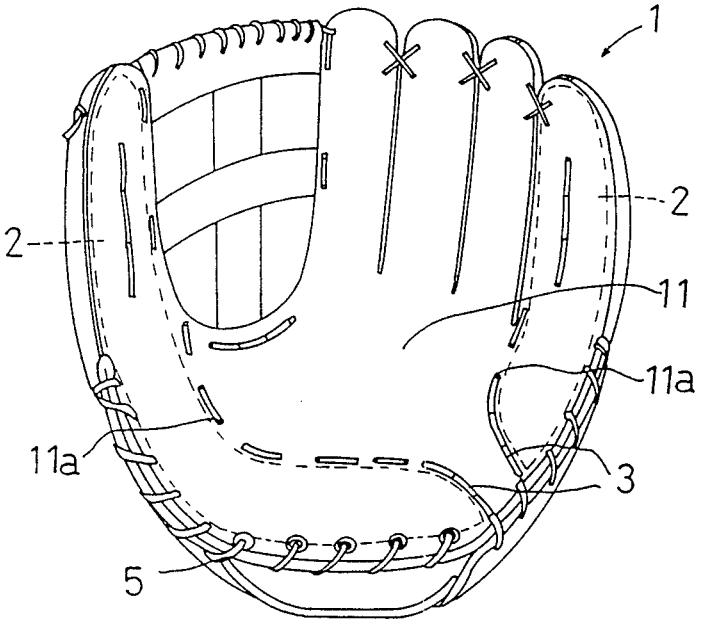
FIG.10 (PRIOR ART)
FIG. 10 is a front view of a conventional baseball catching apparatus as seen from a ball catching face side thereof.
Figure 11:
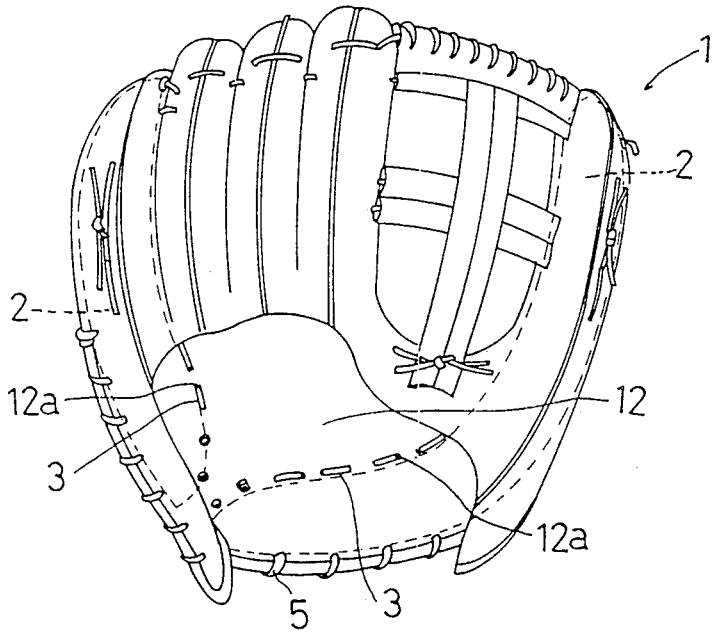
FIG.11 (PRIOR ART)
FIG. 11 is a partially cut-out back view of the apparatus shown in FIG. 10.

As shown in FIG. 9, the shock-absorbing means 2 may be formed of a single element continuously extending from the top through the bottom of the thumb portion of the apparatus to the top of the little finger portion of the apparatus. In this case, the holding means 4 is formed as a cylindrical holding member 43 having openings at both ends thereof, through which the shock absorbing element 23 is inserted thereby being supported at a central portion thereof. The cylindrical holding member 43 may be fixedly positioned in the following manner.

Figure 7:
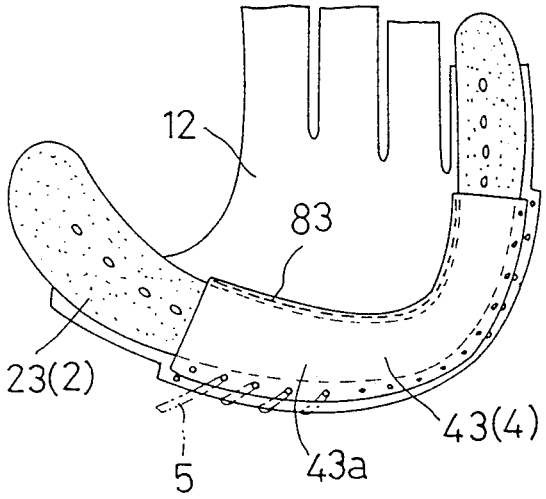
FIGS. 7 and 8 are views illustrating a fourth alternate embodiment of the outer face member, the shock absorbing member and its holding member of the baseball catching apparatus related to the present invention.

Referring to FIG. 7, a flat piece member 43*a* may be fixedly sewn by means of a thread 83 or of the string 5 to the inner face member 12 while leaving the two end openings un-sewn to remain open. Conversely, as shown in FIG. 8, the flat piece member 43*a* may be fixedly sewn to the outer face member 11.

In the cases described above with reference to FIGS. 7 and 8, the flat piece member 43*a* has the peripheral edge portion thereof toward the lower end of the palm fixed by means of the string 5. In place of this, a thread may be used for fixing the same.

Figure 8:
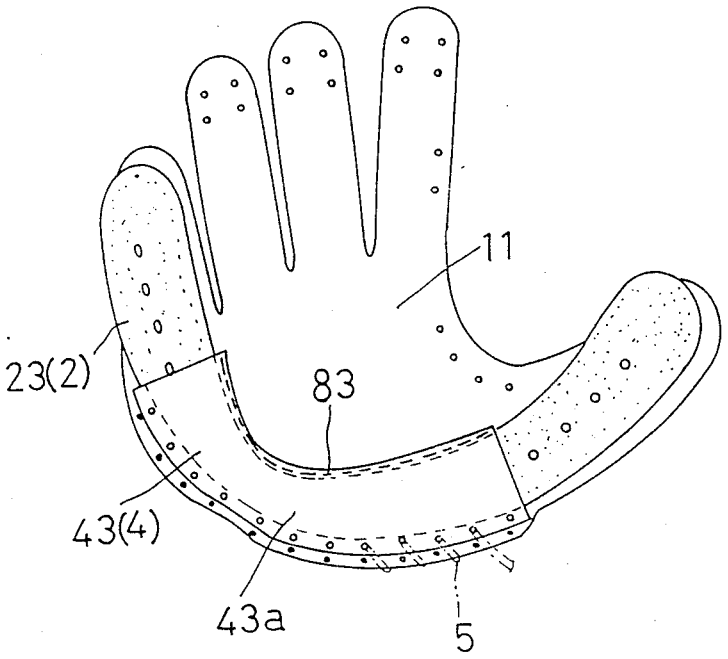

Furthermore, in place of or in combination with the string and of the thread used in the cases shown in FIGS. 7 and 8, the holding means 4 may be fixedly positioned by means of an adhesive or the like.

What is claimed is:

1. A baseball catching apparatus, comprising:

an outer face member constituting a ball-catching face of a palm side;

a string;

an inner face member which comes into contact with a palm, said inner face member being fastened at a lower edge portion thereof to said outer face member by means of said string;

holding means disposed at a predetermined position in between said outer face member and said inner face member, said holding means being provided at least at two positions separately from each other in an area extending from approximately a root of a thumb through the wrist to a root of a little finger, said holding means being secured to either of said outer face member and said inner face member over an entire periphery thereof except for opening portions thereof corresponding to positions of the root of the thumb and the root of the little finger, respectively; and shock-absorbing means to be accommodated in said holding means and adapted for relieving ball-catching shock, said shock-absorbing means being formed thinner at a central portion thereof than at a peripheral portion thereof.

2. A baseball catching apparatus, as defined in claim 1, wherein each said holding means comprises a holding bag.

3. A baseball catching apparatus, as defined in claim 2 wherein each said holding bag is formed as a piece member having a peripheral edge thereof sewn to said inner face member except for a portion thereof remaining un-sewn to form an opening.

4. A baseball catching apparatus, as defined in claim 2, wherein each said holding bag is formed as a piece member having a peripheral edge thereof sewn to said outer face member except for a portion thereof remaining un-sewn to form an opening.

5. A baseball catching apparatus, as defined in claim 2, wherein each said holding bag is formed as a piece member having an upper peripheral edge thereof sewn to said outer face member except for a portion thereof remaining un-sewn to form an opening and a lower peripheral edge thereof fixed by the string for sewing lower edges of an apparatus body together therewith.

6. A baseball catching apparatus, as defined in claim 2, wherein each said holding bag is formed as a piece member having an upper peripheral edge thereof sewn to said inner face member except for a portion thereof remaining un-sewn to form an opening and a lower peripheral edge thereof fixed by the string for sewing lower edges of an apparatus body together therewith.

* * * * *